US009315311B2

(12) United States Patent
Hutchison et al.

(10) Patent No.: US 9,315,311 B2
(45) Date of Patent: Apr. 19, 2016

(54) WEDGE FORM BAG FOR POURING

(71) Applicant: Peel Plastic Products Limited, Brampton (CA)

(72) Inventors: Brian George Hutchison, Brampton (CA); Lorne Andrew Gelz, Brampton (CA)

(73) Assignee: PEEL PLASTIC PRODUCTS LIMITED, Brampton, Ontario (CA)

( * ) Notice: Subject to any disclaimer, the term of this patent is extended or adjusted under 35 U.S.C. 154(b) by 0 days.

(21) Appl. No.: 14/546,086

(22) Filed: Nov. 18, 2014

(65) Prior Publication Data

US 2015/0071571 A1 Mar. 12, 2015

Related U.S. Application Data

(63) Continuation-in-part of application No. 13/655,784, filed on Oct. 19, 2012, now Pat. No. 8,961,012.

(51) Int. Cl.

| | |
|---|---|
| ***B65D 33/10*** | (2006.01) |
| ***B65D 75/00*** | (2006.01) |
| ***B31B 1/00*** | (2006.01) |
| ***B65D 75/58*** | (2006.01) |

(52) U.S. Cl.

CPC ..... *B65D 75/008* (2013.01); *B31B 1/00* (2013.01); *B65D 33/10* (2013.01); *B65D 75/5883* (2013.01); *B31B 2219/9093* (2013.01); *B31B 2219/9096* (2013.01); *B31B 2237/05* (2013.01); *B31B 2237/10* (2013.01); *B31B 2237/50* (2013.01)

(58) Field of Classification Search

CPC .. B65D 31/10; B65D 75/008; B65D 75/5883; B65D 33/065

USPC ..... 383/120, 104, 38, 7, 906, 907

See application file for complete search history.

(56) References Cited

U.S. PATENT DOCUMENTS

| | | | | |
|---|---|---|---|---|
| 2,270,236 | A * | 1/1942 | Blakemore | B65D 75/50 229/104 |
| 2,935,238 | A * | 5/1960 | Koehler | B65D 5/008 116/63 P |
| 6,409,386 | B1 * | 6/2002 | Trani | B65D 75/008 383/104 |
| 7,407,326 | B2 * | 8/2008 | Wilkes | B65D 75/5872 383/104 |
| 7,494,279 | B2 * | 2/2009 | Marquet | B65D 33/008 383/10 |
| 8,961,012 | B2 * | 2/2015 | Martin | B65D 33/10 383/10 |
| 2005/0271306 | A1 * | 12/2005 | Murray | B29C 66/4322 383/38 |
| 2009/0202181 | A1 * | 8/2009 | Alaux | B31B 19/36 383/7 |
| 2015/0158635 | A1 * | 6/2015 | Gum | B65D 75/008 383/25 |

* cited by examiner

*Primary Examiner* — Jes F Pascua

(74) *Attorney, Agent, or Firm* — Stuart L. Wilkinson

(57) ABSTRACT

A bag formed of plastic film material has two side panels with a rear gusset and a bottom gusset extending between the first and second side panels. Margins at front and top edges of the first side panel join margins at front and top edges of the second side panel at a first join. A bottom margin of the rear gusset joins a rear margin of the bottom gusset at a second join. The rear gusset terminates at a top, rear part of the first join and the bottom gusset terminates at a bottom, front part of the first join.

18 Claims, 10 Drawing Sheets

WEDGE FORM BAG FOR POURING

CROSS REFERENCE TO RELATED APPLICATIONS

The present U.S. Patent Application claims priority pursuant to 35 U.S.C. §120, as a continuation-in-part (CIP), to the U.S. patent application Ser. No. 13/655,784 entitled BAG WITH HANDLE, filed Oct. 19, 2012, which is hereby incorporated herein by reference in its entirety and made part of the present U.S. Utility Patent Application for all purposes.

FIELD OF THE INVENTION

This invention relates to a wedge form bag having particular application for standing upright when containing liquid or granular contents and for hand operated pouring of such contents from the bag.

DESCRIPTION OF RELATED ART

Plastic bags are a ubiquitous and highly practical mode of carrying things and there is a whole panoply of shapes and structures of such bags depending on the particular function of the bag. Some bags have closable openings of some kind or other to enable pouring of liquid or granular contents from the bag. Other bags may have handles to enable easy lifting and pouring. Plastic bags are of interest from the viewpoint of low packaging material cost structures that might replace in the marketplace freestanding, relatively thick-walled plastic jugs. Such a replacement is desirable for many reasons. Firstly, the volume of plastic material required in thick-walled plastic jugs is generally much higher in comparison with plastic bags configured to function as jugs. Secondly, placing of graphic materials is much easier on plastic bags where simple printing directly onto a paper-like plastic sheet can be implemented with the plastic sheet or a ply thereof being of a material such as polyester which readily accepts industry standard printing inks. This is in comparison with stiff-walled jugs which generally have some contour in the walls making it difficult for a print head to seat against anything but a very small wall area. This essentially mandates a relatively expensive process step of attaching labels or sleeves to the jugs. Finally, prior to filling, thick-walled jugs being stored or shipped take considerable space in comparison with a compact stack of flat plastic bags.

The structure of a bag that is to function as a jug should have the strength to hold the desired weight and volume of granular or fluid contents. It should also have a form enabling it to be gripped in one hand, moved from a standing into a pouring position and back again, and, ideally, for the standing position to be reasonably well retained as substantially all the contents of the bag are poured from a spout or functionally similar means. Finally, the structure should be easy to manufacture. One known form of bag is the double gusseted bag which has a flat base, two side panels, a front gusset and a back gusset, the front and back gussets terminating at a top seam where the two side panels meet. A recognized difficulty of this form of double gusseted bag is sitting an effective and aesthetically pleasing openable closure near the front top of the bag. Because the closure must be in the same general location as the front gusset termination to enable pouring, a clean and aesthetically pleasing pouring region is difficult to achieve. The problem may alternatively be addressed by vertically separating the locations of the closure and the gusset termination, but it is expensive to use an otherwise non-functional area of film material near the top of the bag and results in a lot of non-functioning empty space, inside and outside, at the top of the bag that does not look good.

Another form of bag having some standing capability is the stand-up pouch (SUP), a bag that is sealed along all four sides except for a single bottom gusset. The SUP does not stand particularly well and can sometimes resemble a collapsed sack While these and other bags are known that can provide a substitute for jugs made of more rigid materials, further improvements are possible to improve the utility, appearance and manufacturability of such bags. Limitations and disadvantages of known approaches to jug substitute bag designs will become apparent to one of ordinary skill in the art through comparison of such bags with the present invention.

SUMMARY OF THE INVENTION

According to an aspect of the invention, there is provided a bag for pouring formed of plastic film material, the bag having a first side panel, a second side panel, a rear gusset extending between the first and second side panels and joined to the first side panel at a first thermoplastic weld and joined to the second side panel at a second thermoplastic weld, a bottom gusset extending between the first and second side panels and joined to the first side panel at a third thermoplastic weld and joined to the second side panel at a fourth thermoplastic weld, a margin at front and top edges of the first side panel joining a margins at front and top edges of the second side panel at a fifth thermoplastic weld, a pouring device interrupting the fifth thermoplastic weld and sealed between the first and second panels at the front top of the bag, a bottom margin of the rear gusset joining a rear margin of the bottom gusset at a sixth thermoplastic weld whereby the rear and bottom gussets have an open gusset condition at the bottom rear of the bag and a handle comprising a first extension portion of the first side panel and a first extension portion of the rear gusset extending rearwardly from the first thermoplastic weld and thermoplastically welded to one another to form a first handle section, a second extension portion of the second side panel and a second extension portion of the rear gusset extending rearwardly from the second thermoplastic weld and thermoplastically welded to one another to form a second handle section, the first and second handle sections having front regions adjacent the first and second thermoplastic welds separate from one another to allow the open gusset condition at the bottom rear of the bag, and having rear regions thermoplastically welded together.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

Figure 1:
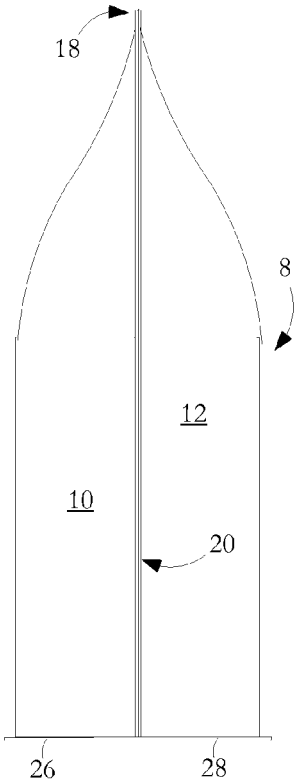
FIG. 1 is a front view of a bag according to an embodiment of the invention.
Figure 2:
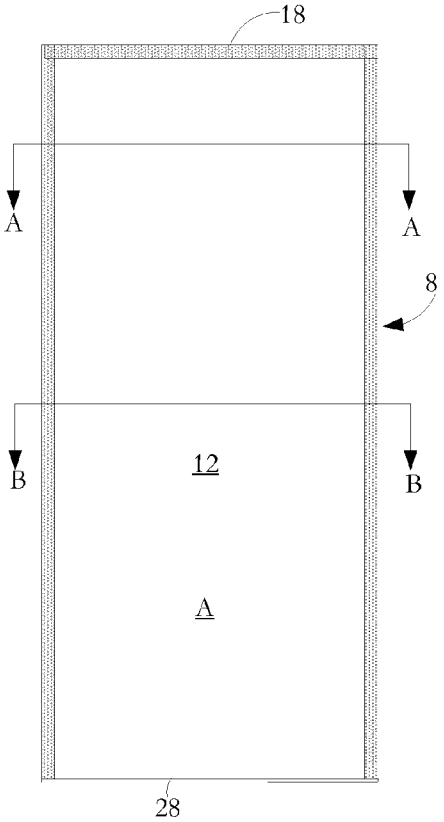
FIG. 2 is a side view of the bag of FIG. 1.
Figure 3:
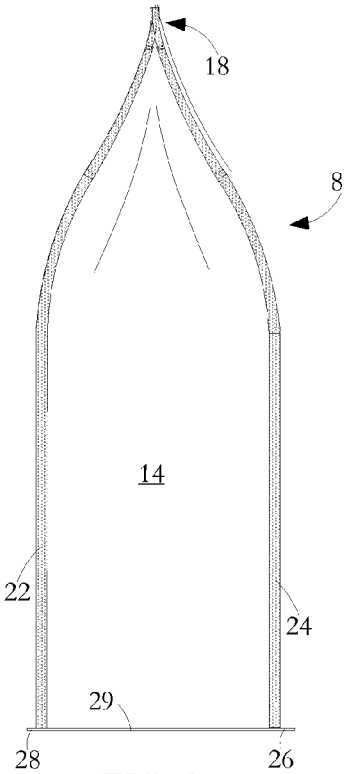
FIG. 3 is a rear view of the bag of FIG. 1.
Figure 4:
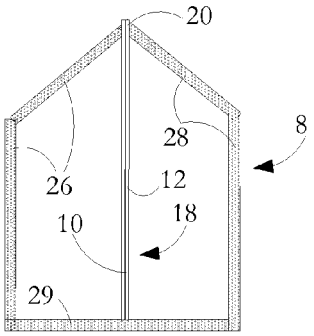
FIG. 4 is a view from the top of the bag of FIG. 1.
Figure 5:
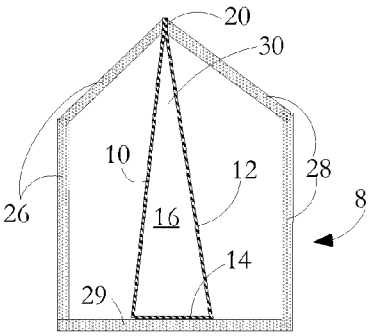
FIG. 5 is a sectional view on the line A-A of FIG. 2.
Figure 6:
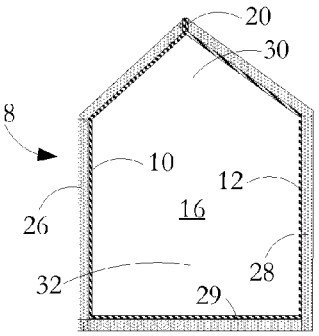
FIG. 6 is a sectional view on the line B-B of FIG. 2.

DETAILED DESCRIPTION OF THE INVENTION INCLUDING THE PRESENTLY PREFERRED EMBODIMENTS

Referring to FIGS. 1 to 6, there is shown a bag 8 according to one embodiment of the invention. The bag has side panels 10, 12, a rear gusset 14 and a bottom gusset 16. The side panels 10, 12 are generally rectangular and meet at a top margin 18 where a thermal weld holds the side panels together in sealing engagement. The panels 10, 12 also meet at a front margin 20, where another thermal weld holds the panels together in sealing engagement. The rear gusset 14 extends between, and is sealed to rear margins of, the side panels 10, 12 at thermoplastic welds 22, 24. The bottom gusset extends between and is sealed to bottom margins of the side panels by thermoplastic welds 26, 28. In contrast with an SUP bag, in the exemplary structures of the present invention, the bottom gusset 16 is not terminated at a vertical back seam. Instead, the bottom gusset at its rear extends across the full width of the bag at the bottom rear of the bag providing a large flat region to support the bag and its contents in a stable manner. The bottom margin of the rear gusset 14 is welded to the rear margin of the bottom gusset 16 at a thermoplastic weld 29.

The bottom gusset 16 deploys to provide a base for the bag when the bag is full of product material and seated on a supporting surface. As shown in the plan and sectional views of FIGS. 4 to 6, the gusset 16 deploys in such a way as to present a front part 30 of the base which is triangular in shape with the apex of the triangular part terminating at the thermal weld 20. Behind the triangular part 30, the bottom gusset deploys as a rectangular shape 32. The bottom gusset 16 provides a stable base for supporting the bag 8 in an upright condition when it is full of product material such a liquid or granular product. The pinning of the bottom gusset 16 at the thermal weld 20 means that the bag adopts a generally wedge form horizontal section over a major part of its height which is illustrated by the sectional view of FIG. 5. In use, the wedge form at the front of the bag is, in practice, not the classic triangular shape illustrated owing to the flexibility of the plastic material of the bag and the tendency for fluid product material contents to settle under gravity as permitted by that flexibility. Nevertheless, a generally triangular form at the front of the bag is retained throughout a major part of the bag height. This is useful for bag stability: in that respect, an item with a triangular base with center of gravity vertically within the triangle has some advantage over other base shapes. It means also that, at least when the bag is standing upright and up to a certain tipped pouring position, the center of gravity of the bag contents is closer to the rear of the bag than to its front.

The triangular form 30 at the front of the bag offers some advantage for one-handed handling where the bag is gripped, lifted, or poured. In one embodiment, the width of the rear gusset 14 is set such that when the bag 8 is full of liquid or granular contents, it fits comfortably within the palm of the hand. In this position, for a right-handed person, the palm is against the rear gusset 14, the thumb presses at point A of the side panel 12, and the fingers press at a corresponding point of the other side panel 10. The front-to-back length of the bag 8 is made such that over a unit height of the bag, there is more product material bulk to the rear of the person's grip at point A than product material bulk in front of the grip point A. When the person grips at point A, the product material contained in the bag presents a reaction, the reaction forces depending on a number of factors but including the location, orientation, and extent of elastic yielding of bag panel material near the grip position, and the density of packing of product material surrounding the grip position. The triangular form 30 at the front of the bag determines that when the bag 8 is gripped, the contents initially yield more in the front of the bag than the rear, so permitting the grip to close somewhat in the manner of a claw before the reaction from the bag boundary acting through the contents halts further closure of the grip. The product material contents are also somewhat redistributed vertically as a result of the bag being gripped so that a further preferential yielding as between front and back of the bag is contributed by material above and below the grip position.

Figure 7:
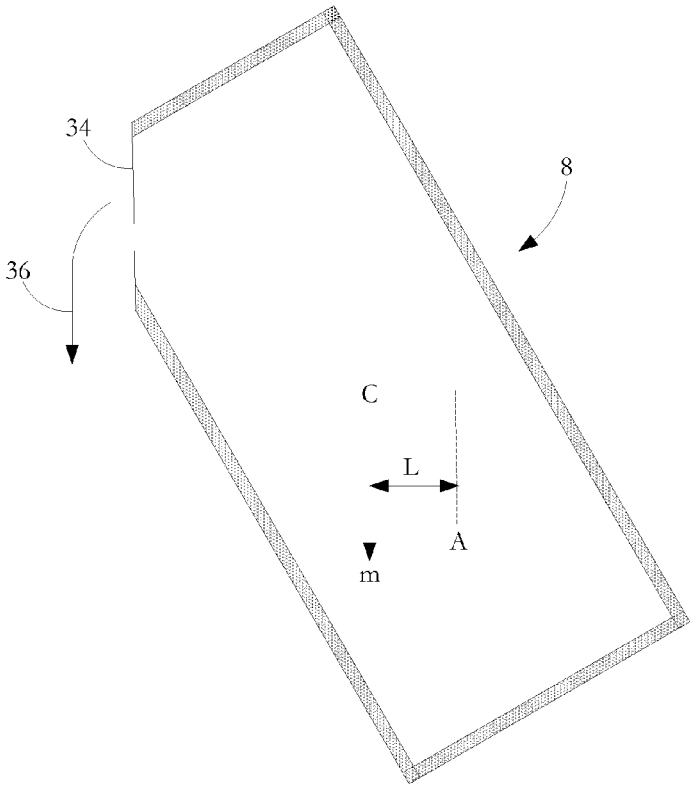
FIG. 7 is a side view of the bag of FIG. 1 showing the bag in pouring mode.

As shown in FIG. 7, when product material is to be poured from an opening at the upper front of the bag, the bag is lifted and tipped forwardly. The wedge form front 30 of the bag means that the center of gravity C of product contents is more towards the back of the bag than the front. This, in turn, means that, at least during an initial pouring stage, there is less moment acting on the pourer's hand than, for example, is the case for a conventional double gusseted bag having identical gussets at the front and back. As the bag 8 is tipped further forwardly, the benefit of a reduced moment is no longer achieved because the center of gravity of the illustrated bag is necessarily somewhat higher in contrast with, for example, a double gusseted bag of similar width and displacement, meaning that as shown in FIG. 7, in the moment (m×L) of product material acting about the grip position A, the distance L is greater than for the contrasted bag. However, this is not a serious concern because m, the mass of product material acting about the grip position A, is much reduced owing to product material having previously been poured from the bag with the bag tipped at a less forward angle.

For comfortable gripping by a normally sized hand, a bag as illustrated in FIGS. 1 to 6 which has no adjunct handle, has a preferred bottom gusset width in the range 1.5 and 3.5 inches and a preferred bag length between the expanded rear gusset 14 and the front part of the front join 20 of from 4 and 6.5 inches. However, these are only preferred ranges and it is contemplated that within the wedge form bag of the invention larger sizes of width and length may be satisfactory for particular configurations of the bag.

Figure 8:
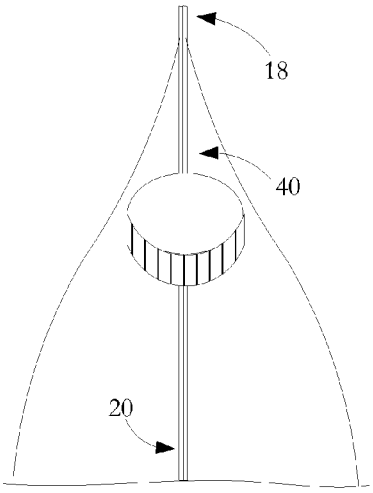
FIG. 8 is a scrap front view of the top of a bag according to an alternative embodiment of the invention, the bag fitted with a reclosable opening in the form of a spout and cap.
Figure 9:
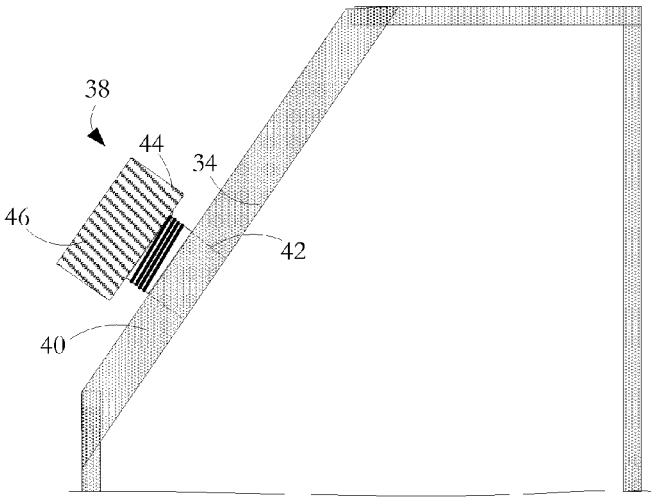
FIG. 9 is a side scrap view corresponding to FIG. 8.

The bag illustrated in FIGS. 1 to 6 has a pouring opening 34 which is achieved by the user taking the closed bag 8 and cutting away its top front corner. Product material is then poured through the opening. Such an opening cannot easily be closed and resealed, for example, to preserve the remaining contents in the bag. The bag partially illustrated in FIGS. 8 and 9 has a reclosable pouring device located near the front top corner of the bag. In contrast with the double gusseted bag previously mentioned, there is no gusset at the front of the wedge form bag. Consequently, the pouring device does not have to share real estate with a gusset termination and so a relatively clean and aesthetically pleasing pouring region can be achieved. This also obviates any use of expensive, essentially non-functional film material at the front top of the bag to accommodate the closure and a neighboring gusset termination by separating them vertically. The reclosable pouring device is a capped spout which is sealed into the front top of edge of the bag. In this embodiment, the top front edges of the side panels are cut away so that the side panels meet at a diagonally extending margin. At this margin, a further thermal weld holds the panels together in sealing engagement except at an intermediate position, where respective parts of the diagonally extending margin embrace and sealingly engage a spigot forming part of the spout. The spigot has an externally threaded upper section adapted to receive a screw cap for closing the spout to prevent loss or deterioration of the bag contents. The reclosable pouring device can alternatively be configured over a part or whole of the diagonal margin by means of a press-to-close zipper, a slider zipper or a Velcro®-type fastening, each well known in the art for application to other bag designs. In further alternative embodiments of the invention, the top margin 18 or front margin 20 of the bag accommodates a reclosable pouring device. Although the preferred side panel shape is rectangular, for aesthetic, balance or other purposes, a right angled, diagonal, rounded or other form can be implemented at the top front and/or the top rear corners of the bag.

The size of a pouring opening should be limited in size so as to prevent accidental over-pouring. A restricted opening size can however present a difficulty in the case of granular materials which, as they approach a constricted opening, may jam together and form a restricting bridge at the opening, so preventing further granules from passing through it. In the event of such a jam, it is necessary to dislodge the jam by poking or shaking before pouring can be resumed. In the bag of the invention, the pouring opening is positioned near the front top of the bag where margins of the two sides of the bag are welded directly together. Sides of the bag converge in the region of the opening from the rear and bottom gussets and have a V disposition immediately adjacent the seam which may be any of the margin regions 18, 20, 40. This means that product material being poured from the interior of the bag is channeled as it approaches the top front corner opening. This funneling effect has value firstly in automatically regulating the delivery of product material to the opening. In addition, as granular product approaches the closure, a particular granule is not subjected to significant surrounding packing pressure, even when the bag is relatively full and well packed. This arises because the packing of product material is governed by two seams—the top seam 18 and the side seam 20—neither of which is part of a gusset so neither of which offers much opportunity for product material to crowd in and pack against surrounding product material. Even if the bag is tipped forward, there is still limited opportunity for packing and jamming. The packing density at the front corner is relatively light and this helps in the generation of a smooth unplugged flow of poured material.

Figure 10:
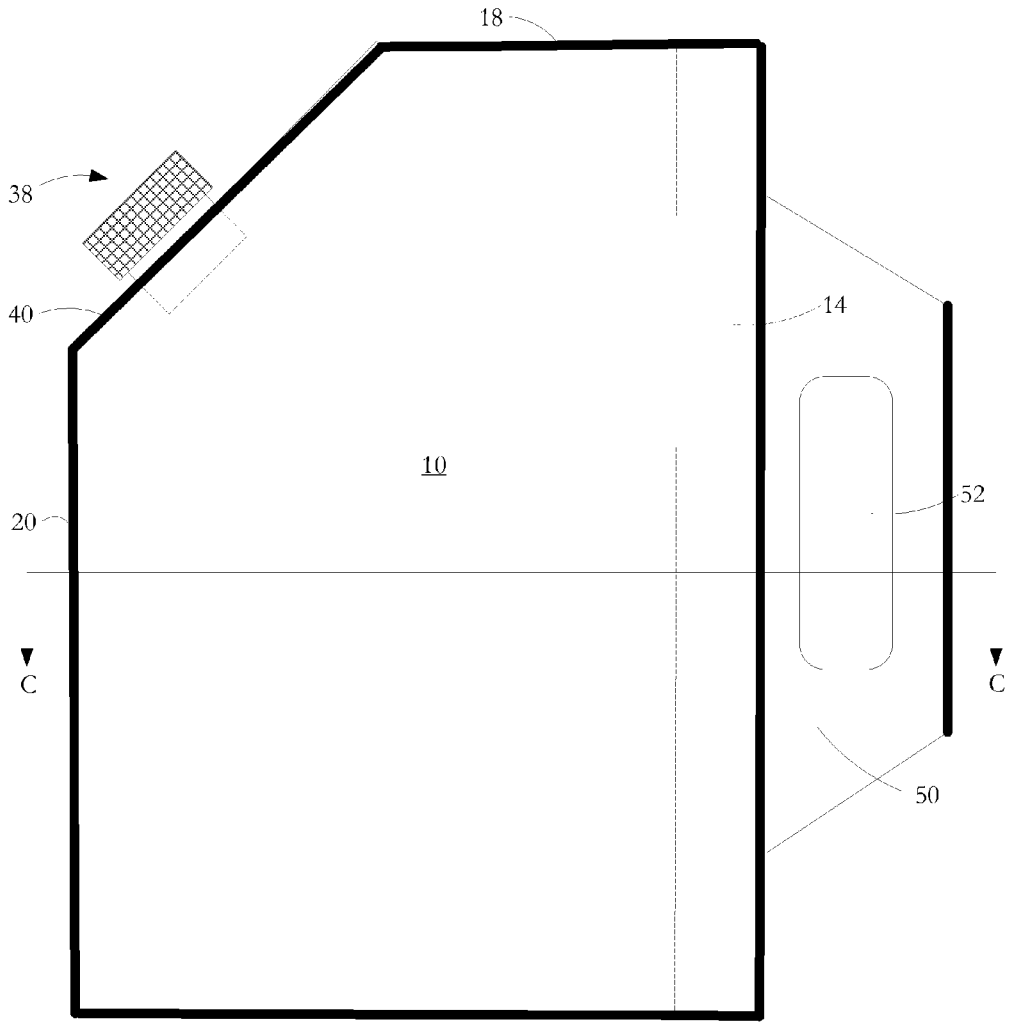
FIG. 10 is a side view of a bag according to another embodiment of the invention, the bag having a handle.
Figure 11:
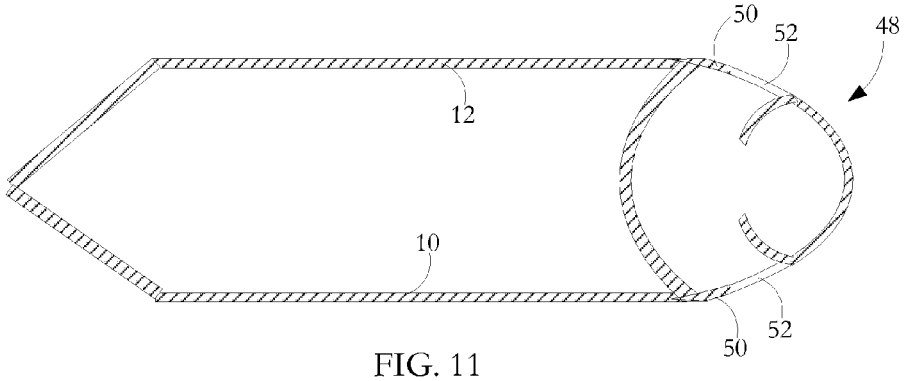
FIG. 11 is a sectional view on the line C-C of FIG. 10.

The bag 8 illustrated in FIGS. 1 to 6 has no handle and is gripped and lifted by simply gripping the bag. In contrast, the bag embodiment of FIGS. 10 and 11. has a handle. The illustrated handle is as described in co-pending U.S. patent application Ser. No. 13/655,784 which is herein incorporated by reference in its entirety. The bag 8 has first and second side panels 10, 12 and a rear gusset 14. Either or both of the side panels 10, 12 and the rear gusset 14 have extensions 50. The extensions from opposite sides of the bag are welded together with the width of the combined extension being greater than the width of the rear gusset 14. The handle extensions 52 are formed with carrying apertures 52 to enable the bag to be carried. Other forms of handle known in the art can also be incorporated in a bag according to the present invention, the bag forming an integrated whole with the sides and/or rear gusset of the bag.

The handle 48 facilitates lifting, carrying and pouring compared with the unhandled bag because the user does not have to squeeze product material out of the way to establish a grip on the bag. Also, size for size, a heavier bag can be handled owing to the handle having vertical length. With the bag lifted clear of a support surface and the handle gripped in the user's fist, it enables a levering action with the top of the fist pulling against and balancing the moment of the bag's weight and the bottom of the fist acting as a fulcrum. This same lever action means that in comparison with the unhandled bag, a larger moment m×L can be contemplated without the user experiencing discomfort when lifting the bag.

It will be appreciated that the handle may be held atop the bag for carrying but is normally held at the side for pouring. To assist in the carrying mode if the bag contents will be heavy, one or more of its seams can be strengthened as part of the manufacturing process. A strengthening rod, tube or leaf of thermoplastic material is located at the region of a weld prior to welding so that when the weld is completed it provides greater stiffness than is obtained from a weld made solely of the thermoplastic sheet materials. This may be particularly valuable for a bag to function as a pouring jug. Some dexterity may be necessary in handling a jug having the handled and unhandled bag forms described herein, especially if most of the original contents of the bag have been dispensed.

A bag as described and illustrated is typically made using a continuous production process. To obtain a high production rate, processing operations are performed on continuous webs of plastic sheet material: a primary web and a rear gusset web. During a production run, the primary web is fed continuously under tension from an input end where the web is unformed to an output end where, essentially, a complete bag has been produced and is cut from the web leading end. The web is led past a series of processing stations where the web may be temporarily halted or remain moving while processing operations are performed including, for example, positioning, stamping, cutting, folding and thermoplastic welding, the particular operation depending on the stage of manufacture of the bag.

An abbreviated sequence of folding, cutting and welding steps convenient for use in manufacturing a bag according to an embodiment of the invention is as follows:

1. A large web is pulled off a supply roll and cut into two main bag webs which run in the same direction, one above the other with a space between
2. The lower main web is wider by an amount $L_1$ than the upper main web.
3. A separate gusset web for the rear gussets is folded along its length, with fold towards the intended interior of the bag and is fed transversely into the space.
4. A leading section of the gusset web is tack welded between the top and bottom main bag webs.
5. An edge part of upper main web having a width of $L_1/2$ and having a part of the folded rear gusset web tacked to it is folded upwards and back on itself to produce a fold.
6. The extra width $L_1$ part of the lower main web is also folded upwardly and back on itself to cover a part of the tacked rear gusset material and the folded part of the upper main web.
7. A longitudinally extending fold is made down the center of the $L_1$ overlapping part of the lower web, the fold towards the intended interior of the bag. In the flattened condition, dimensions are such that this fold is aligned with the fold in the upper main web. The region of width $L_1$ functions as the bottom gusset in the finished bag.
8. This assembly is then subjected to thermal welding to effect thermoplastic seals as discussed with respect to the previous figures. The leading part of the main webs with intervening rear gusset material attached is then cut off. Elements of the partially finished assembly may also be trimmed either before or after thermal welding and recloseable opening fitments may also be installed.
9. Meantime, further sections of the main webs and the rear gusset webs are advanced to for a repeat of the process for the next bag to be made.

The several panels of a bag 8 according to the invention have different functions and therefore to some extent need different properties. Thus, the two side panels 10, 12 have to contain the product materials, but do not have large product pressure acting from within. The side panels offer the most convenient and most visible locations in which to print product indicia such as the nature of the product, its properties, its maker, regulatory matters, best-before date, etc.

A particular function of the rear gusset 14 is to remain upright to the extent possible both when the bag 8 is full and after it has been partially emptied. In one embodiment, the rear gusset 14 is made of stiffer material than the rest of the bag. Alternatively or in addition, a locally strengthened zone is formed either in stock gusset material or during manufacture by positioning a thermoplastic rod at the site of the seam welds. When the bag is used to pour, a strengthened seam or zone assists in maintaining the jug form of the bag, especially as the bag nears an empty condition.

A particular function of the bottom gusset 16 is to present a firm flat supporting base. In support of this function, in another embodiment of the invention, the bottom gusset is made of stiffer film material than other parts of the bag. Alternatively or in addition, the bottom gusset, where it is welded to the side panels 10, 12 and the rear gusset 14 has a margin weld oriented as a coplanar extension of the main part of the bottom gusset 16. The margins of plastic film material which are used to make thermoplastic seals are typically from 0.25 to 0.375 inches wide. All or part of the bottom gusset margin can be made relatively wide to add width and/or length to the base area to the bag. The margin weld can also be stiffened as described previously with respect to the rear gusset.

Figure 12A:
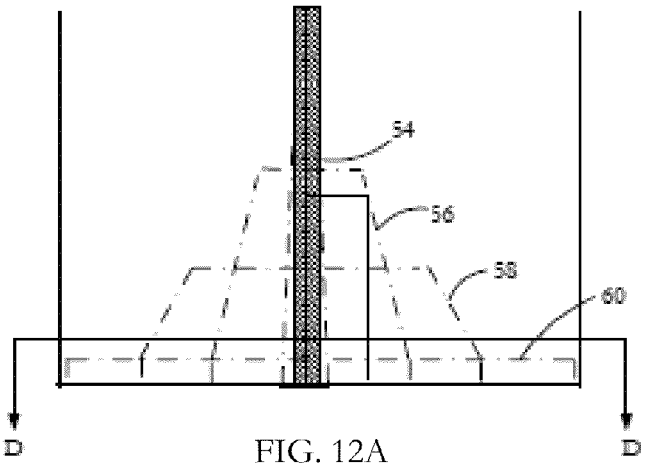
FIG. 12A is a scrap front view showing the configuration of plastic film material at the bottom front of a bag according to an embodiment of the invention, the bag shown with bottom gusset deployed.
Figure 12B:
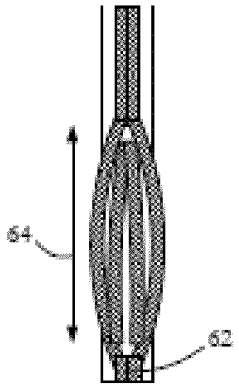
FIG. 12B is a scrap front view corresponding to the configuration of FIG. 12A but showing the bag and bottom gusset in a folded state with bottom gusset not deployed; i.e. still folded as is the case when such bags are stored or shipped.
Figure 12C:
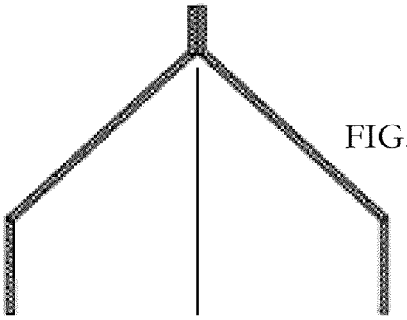
FIG. 12C is a sectional view of on the line D-D of FIG. 12A.
Figure 12D:
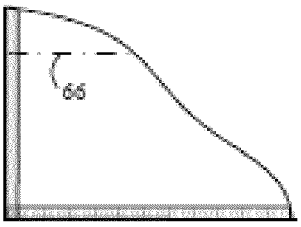
FIG. 12D is a scrap side view corresponding to FIG. 12A.

It will be seen that although the bottom gusset 16 is rectangular in shape, in the course of manufacturing the bag, the gusset material is folded and its front margin is welded to the side panels 10, 12. This weld is obtained in such a way that when the bag is filled with product, the gusset 16 expands to adopt the triangular form 32 at its front end and to present a flat bag base 32 to enable the bag to be stably seated on a supporting surface. One configuration for the front of the bottom gusset 16 is shown in FIGS. 12A to 12E. The manner in which the bottom gusset 16 deploys in the triangular front portion of the bag is illustrated in FIG. 12A where the chain lines represent different vertical sectional layers of the gusset at different positions along the triangular portion 30. Near the front of the triangular portion 30, the gusset orientation is roughly as represented by the chain line 54. Further back along the triangular portion 30, it is as represented by the line 56; and further back still by the line 58. Finally, behind the triangular front portion 30 the gusset 16 flattens out as shown at 60 and becomes the base of the bag 8.

As is known in the art, overlapping marginal regions of the web/panels which are to be thermally welded together are passed through a series of heat welding stations at which a hot press tool applies heat and pressure through a non-thermoplastic ply—typically polyester which is amenable to printing—to hot melt the underlying thermoplastic ply—typically polyethylene. The polyester, and possibly other internal plies such as a barrier layer and/or a strength ply, are not melted but they transmit sufficient applied heat to the polyethylene to melt it. The plastic film material used therefore has only one surface thermoplastic ply and so at every weld, the thermoplastic ply of one piece of the film material must face the thermoplastic ply of the piece to which it is to be welded. In the configuration of FIG. 12 as shown in front scrap view at FIG. 12B, the thermoplastic plies 62 of the respective side panels 10, 12 face each other and are welded at the extreme bottom front corner as shown 62. Immediately above this location, over a short vertical span 64, one part of the bottom gusset 16 is welded to a margin of the side panel 10 and another part of the bottom gusset is welded to a margin of the side panel 12. As shown in the scrap side view of FIG. 12D when the bag is empty with the two side panels flat against each other, such as is the case for storage and shipping of empty bags, the bottom gusset 16 is folded as shown at 66.

Figure 12E:
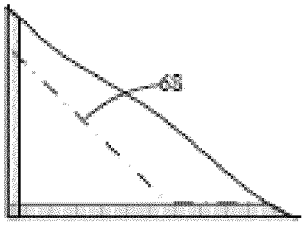
FIG. 12E is a scrap side view corresponding to FIG. 12B.
Figure 13A:
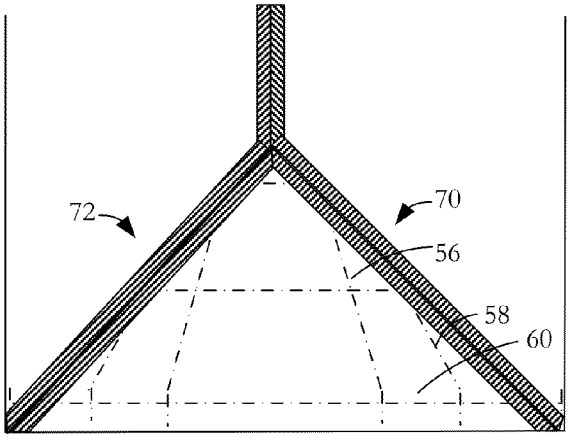
FIG. 13A is a scrap front view showing the configuration of plastic film material at the bottom front of a bag according to another embodiment of the invention, the bag shown with bottom gusset deployed.
Figure 13B:
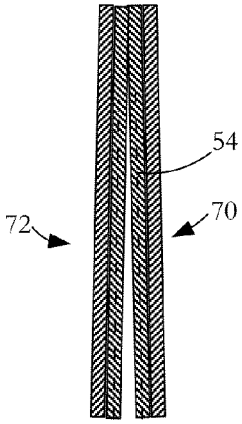
FIG. 13B is a scrap front view corresponding to the configuration of FIG. 13A, but showing the bag and bottom gusset in a folded state with bottom gusset undeployed.
Figure 13C:
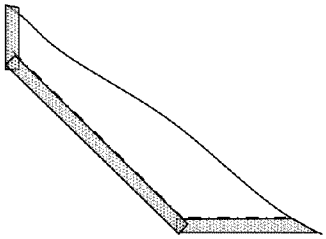
FIG. 13C is a scrap side view corresponding to FIG. 13A.
Figure 13D:
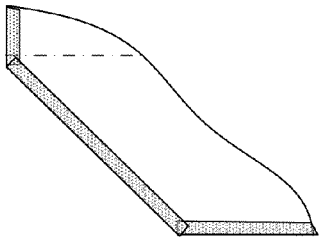
FIG. 13D is a scrap side view corresponding to FIG. 13B.
Figure 13E:
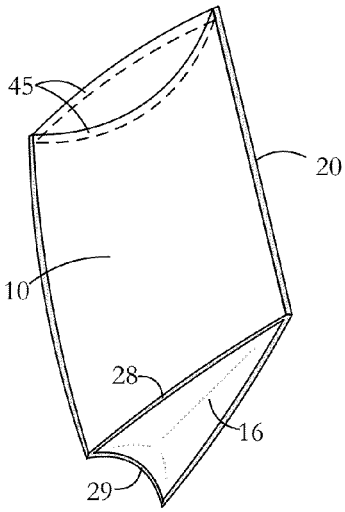
FIG. 13E is an isometric view from below and one side showing a bag according to an embodiment of the invention with the bag in a ready-for-filling condition.
Figure 13F:
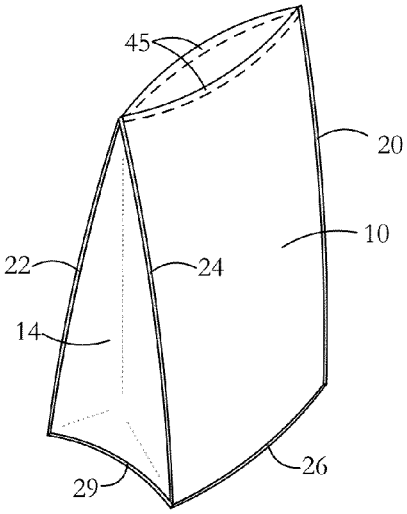
FIG. 13F is an isometric view from above and said one side showing the bag of FIG. 13E.

When the bag is filled, the bottom gusset 16 unfolds and becomes deployed roughly as shown in FIG. 12E by the chain line 68 which represents a vertical longitudinal section through the center of the gusset.

An alternative bottom front configuration is shown on FIG. 13. As shown in FIG. 13A, bottom parts of the front margins of the side panels 10, 12 are not welded together. Instead, the bottom margin part of panel 10 is welded to one part of the front margin of gusset 16 at weld 70, and the bottom margin part of panel 12 is welded to the remaining part of the front margin of gusset 16 at weld 72.

If hermetic sealing of the bag is not important, the junctions between the various panels can be achieved using an adhesive instead of thermal welding.

In the course of production of the bag, typically one seam is left open to allow customers to fill the bag, this seam then being welded by the customer to close and if necessary to seal the bag after the bag is filled. The seam that is most conveniently left open for shipping is at the bag top edge. As shown in FIGS. 14A and 14B, top margin regions 45 of each of the side panels 10, 12 show the site for the top seam.

It will be appreciated that the side panels can have a shape that is other that generally rectangular, provided that there is a rear gusset 14, a bottom gusset 16 and provided that the front and top margins 18, 20 of the bag meet directly with no intermediate gusset.

Figure 14:
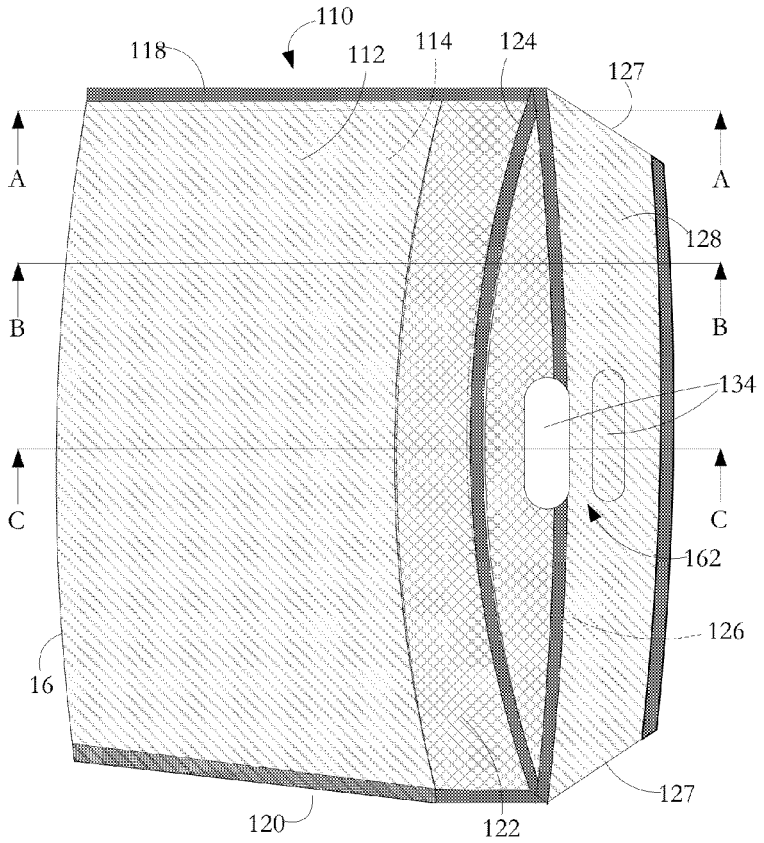
FIG. 14 is a side view of a bag according to an embodiment of the invention.
Figure 15:
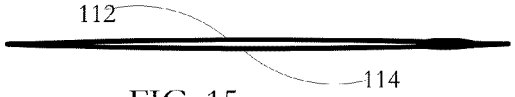
FIGS. 15 to 17 show sectional views on the lines A-A, B-B, and C-C respectively of FIG. 14 when the bag contains granular or fluid material.
Figure 16:
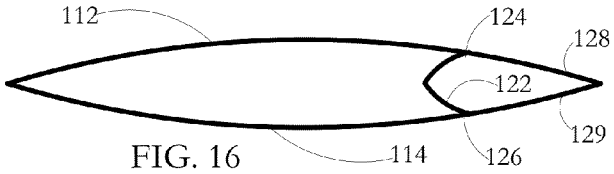
Figure 17:
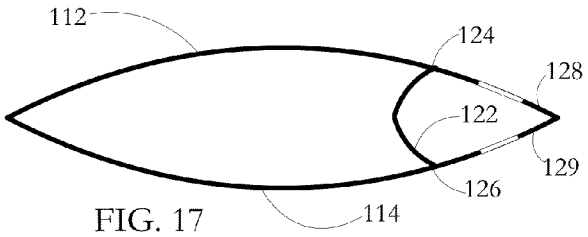
Figure 18:
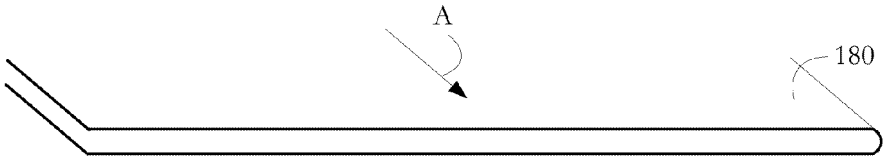
FIGS. 18 to 22 show successive views of parts of the bag of FIG. 14 in the course of its manufacture in a handle side mount process according to an embodiment of the invention.

Referring to FIG. 14, there is shown a pouch form bag 110 formed of plastic sheet material having a front panel 112 and a back panel 114. The front and back panels 112, 114 are joined at one side 116 either as a seam weld, by folding of the original web sheet material from which the bag is formed, or by a gusset panel. At the top and bottom of the bag, the front and back panels 112, 114 are joined by seam welds 118, 120, but could alternatively incorporate gusset panels either as separate panels welded to flanking panels 112, 114 or formed as a fold in the sheet plastic material. A side gusset panel 122 extends between panels 112, 114 and is seam welded to them at welds 124, 126. Extending from the seam welds 124, 126 on the distal side of the welds from the panels 112, 114 are panel extension pieces 128, 129. The extension pieces 128, 129 each have a slot form aperture 134 formed generally centrally within the extension pieces, the apertures 134 being aligned with each other, the extension pieces together forming a handle 162. The extension pieces 128, 129 are cut away as shown at 127 to allow the gusset panel 122 to operate effectively when the bag is filled. The structure of FIG. 14 is shown in cross-section in FIGS. 15-17.

Further details of the structure of the FIG. 14 bag are illustrated by FIGS. 18-23 which illustrate stages in an exemplary production process for the bag. The production process is particularly adapted to the use of a sheet material having two face plies, one made of a material having high thermoplasticity and the other made of a material which is relatively unthermoplastic. Such a sheet material could, for example, be a multi-ply sheet plastic material having a thermoplastic polyethylene ply at one surface and a polyester ply at the reverse surface, the latter being particularly suited for accepting printed indicia but not being thermoplastic.

Figure 19:
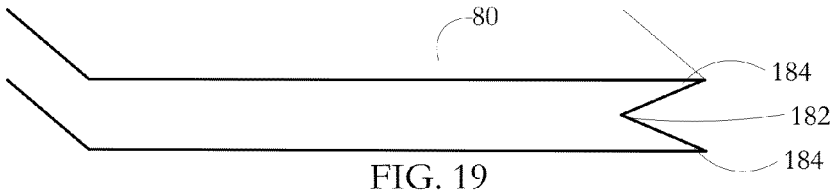
Figure 20:
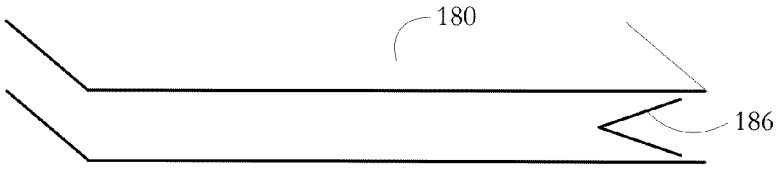

To obtain a high production rate, processing operations are performed on a continuous web of plastic sheet material. During a production run, the web is fed continuously under tension from an input end where the web is unformed to an output end where, essentially, a complete bag has been produced and is cut from the web leading end. The web is led past a series of processing stations where processing operations are performed including, for example, positioning, stamping, cutting, folding and thermoplastic welding, depending on the stage of manufacture of the bag. As shown in FIGS. 18 to 22 which depict a handle side mount production process, a leading end portion of such a web 180 is shown moving in the direction of arrow A. The web is folded (FIG. 18) and a tuck 182 is formed at the location of the fold (FIG. 19). At a subsequent station, the web is slit (FIG. 20) at apices 184 of the two folds formed by the tuck 182. This creates a separated V-section gusset panel 186 which is then combined with a handle web 188 at a combining station.

Figure 21:
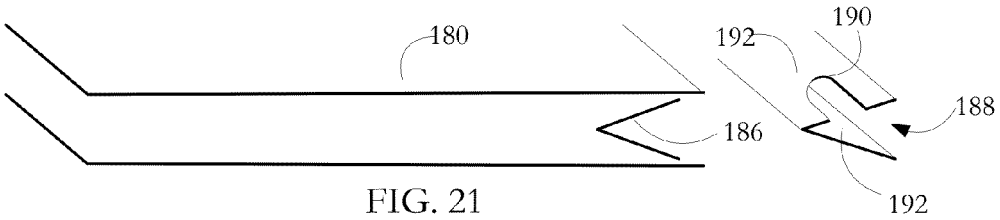
Figure 22:
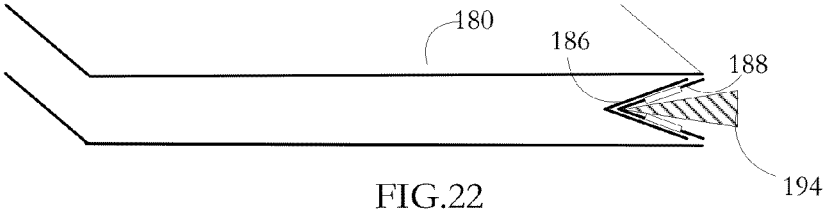

Before reaching the combining station, the handle web 188 is similarly processed as a continuous web drawn under tension (FIG. 21). The handle web 188 in this embodiment is made of polyethylene sheet material but, if desired, a multiple ply plastic sheet material can be used. For example, a nylon ply can be incorporated for strength, while a polyester ply can be used if the handle is to receive printed indicia. The handle web 188 is subjected to a stamping step to create carrying apertures 190 and to a folding step to produce wing sections 192 with an aperture 190 located at the center of each wing section 192. The two webs 180, 188 are brought together at the combining station and, using a positioning blade 194, the folded gusset and handle panels 186, 188 driven to the left as shown so that they lodge a precise distance into the gap between panels of the folded bag web 180 (FIG. 22).

Figure 23:
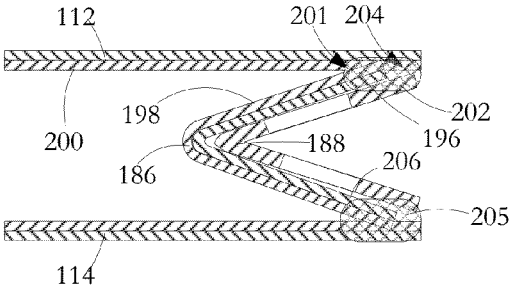
FIGS. 23 and 24 show sectional views to a larger scale of part of the bag of FIG. 14 during its manufacture.
Figure 24:
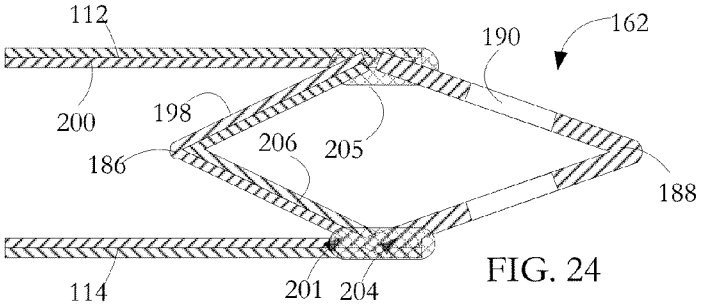

As shown in FIG. 23, the method of cutting and positioning results in a desired juxtaposition of polyethylene plies to enable thermoplastic welding/sealing. Thus, regions 196 of the gusset panel 186 have a polyethylene ply 198 facing a polyethylene ply 200 of the bag panels 112, 114 at contact regions 201. Regions 202 of the polyethylene handle part 188 also face the polyethylene ply 200 of the bag web panels 112, 114, but at regions 204 immediately adjacent the regions 201. The overlapping parts of the webs, including the handle part, are then passed through a series of heat welding stations where a weld 205 is effected to cover both the regions 201 and 204. The hot press tool (not shown) applies heat and pressure through polyester plies to hot melt the underlying polyethylene of the panel edges and the edges of gusset part 186 and handle part 188. The polyester plies are not melted but they do transmit the applied heat to the polyethylene. FIG. 23 depicts a finished bag with the handle 162 nestled against gusset panel 122 whereas FIG. 24 shows the handle 162 pulled out to a position it would have for carrying or pouring purposes.

Figure 25:
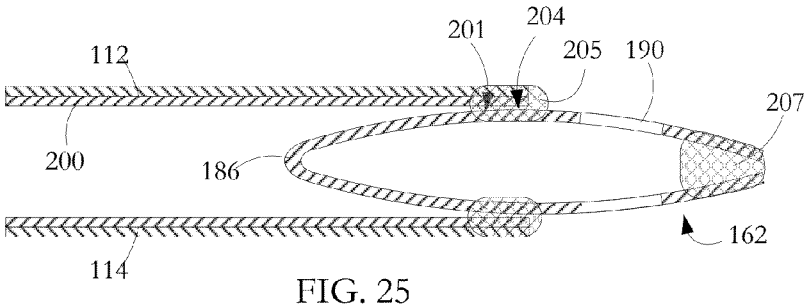
FIG. 25 shows a sectional view at the same larger scale illustrating an alternative handle construction being formed during manufacture of a bag.
Figure 26:
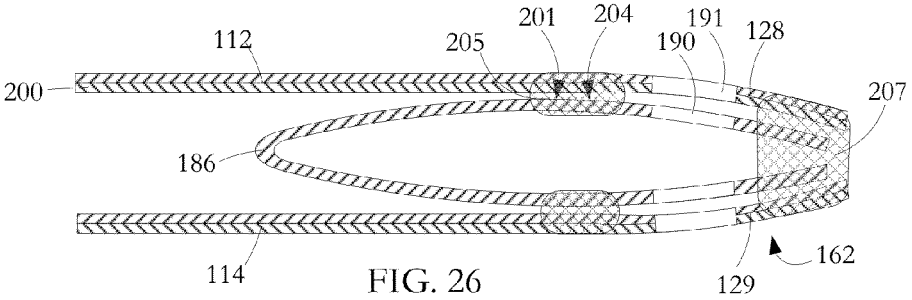
FIG. 26 shows a sectional view at the same larger scale illustrating a further alternative handle construction being formed during manufacture of a bag.

Referring in detail to FIGS. 25 and 26, there are shown alternative handle arrangements. As in the embodiments of FIGS. 23 and 24, these have the merit of a desired juxtaposition of polyethylene plies to enable thermoplastic welding/sealing. A particular advantage of these embodiments is that in the course of production, and in comparison with the process described with reference to FIGS. 18 to 22, no separate insert is required. Instead, a folded strip is cut from the web, in a process step similar to that illustrated in FIG. 20. The folded strip therefore has the same multi-ply structure as the primary web and so has one face which can be heat welded and the other face which is not thermoplastic. The folded strip is the source of both the bag handle and the associated gusset panel.

In the case of the FIG. 25 structure, such a folded strip 168 is partly inserted into a gap between the front and back panels 112, 114 so that parts of the folded strip project out beyond the front and back panels 112, 114. The projecting parts have apertures 190 by means of which the completed bag can be carried. The inserted part of the folded strip makes up the gusset panel 186 and the outwardly projecting parts are joined together and function as the carrying handle 162. End regions of the gusset panel 186 contact respective edge portions of the polyethylene ply 200 of the bag web panels at respective junction contact regions 201. The polyethylene plies of the gusset panel and the respective front and back panels are welded at those junctions as shown at 205. Edge regions of the outwardly projecting parts of the folded strip contact each other at a further junction region and the contacting polyethylene plies are glued together as shown at 207. Whereas welds and glued areas are shown as thick structures, it will be understood that this is for illustrative purposes only. In fact, welded areas are normally of sheet plastic form almost indistinguishable from the sheet plastic making up the bag panels. For strength and handling comfort the welds 205 and 207 extend almost to the apertures 190 but the boundaries of the welds are separated from the boundaries of the respective apertures by a distance of about one quarter of an inch.

In the case of the FIG. 26 structure, the folded strip is fully inserted into a gap between extensions 128, 129, respectively, of the front and back panels 112, 114. An inner part of the folded strip makes up the gusset panel 186 with end regions of the gusset panel 186 contacting and heat welded at welds 205 to respective inner surface portions of the polyethylene ply 200 of the bag web panels at respective junction contact regions 201. Outer parts of the folded strip have apertures 190 aligned with apertures 191 in the front and back panels 112, 114, the aligned apertures in the completed bag serving to enable carrying of the bag. Outer edge regions of the folded strip and outer edge regions of the extensions 128, 129 of the front and back panels 112, 114 contact each other at a further junction region where all four layers are welded at weld 207.

Figure 27:
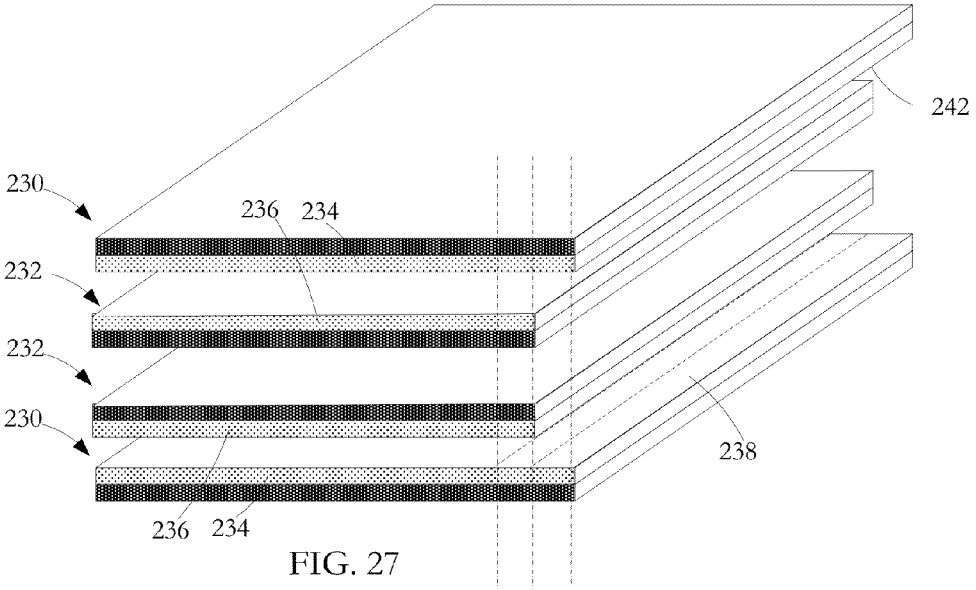
FIGS. 27 and 28 illustrate techniques for welding sheet plastic material according to embodiments of the invention.

As illustrated in FIGS. 23 and 24, the contiguous welds at regions 201, 204 can provide a strong, sealing union between pieces of a plastic sheet material which have a heat weldable ply at one surface and a non-heat weldable ply at the opposite surface. As shown in the exploded view of FIG. 27, the union is characterized by plastic sheets 230, 232 having heat weldable plies 234, 236 facing one another but with the sheets 230 projecting beyond respective sheets 232 to form projecting margins 238. In this arrangement, a single weld with contiguous regions serves to weld each sheet 230 to its adjacent sheet 232, but also serves to weld the two sheets 230 together. The multiple union thermal weld may find application in structures additional to the bag handle arrangement shown in the previous figures, particularly where the need to print indicia or the need for other characteristics of the sheet plastic material mean that a ply at one surface does not lend itself readily to thermoplastic welding whereas a ply at the opposite surface is heat weldable.

Figure 28:
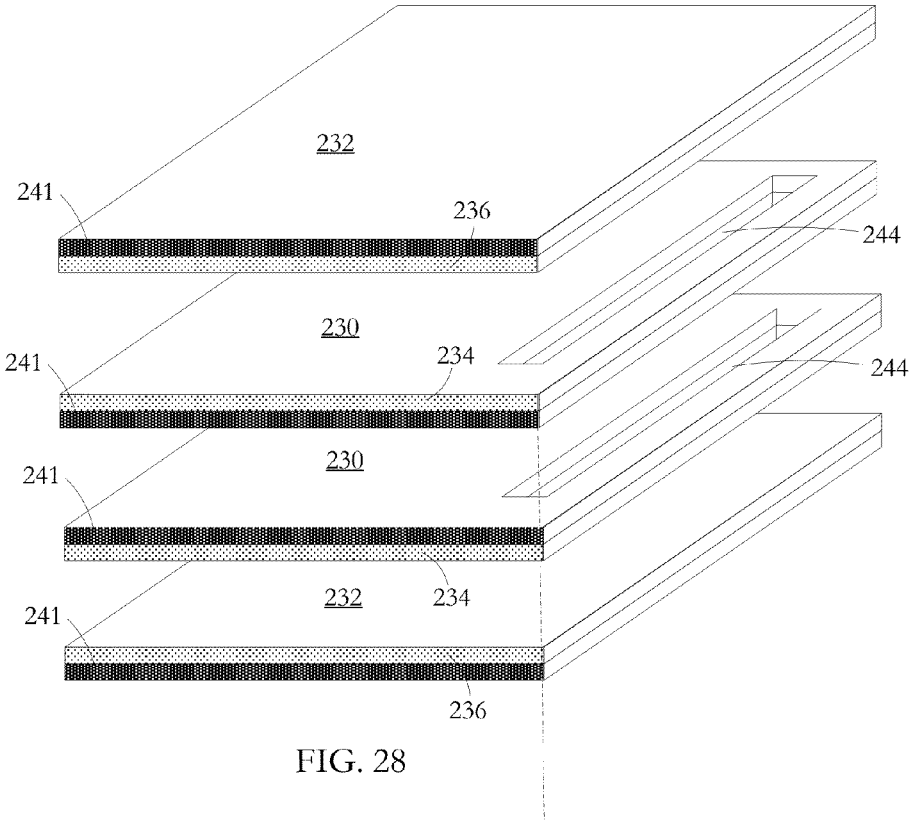

An alternative implementation is illustrated in FIG. 28. Here, plastic sheets 230 and 232 have polyethylene plies 234, 236 facing one another and plies 241 at their other surfaces that are not thermally weldable. The sheets 230 have apertures 244 by means of which a polyethylene ply 236 of one of the sheets 232 is exposed to the polyethylene ply 236 of the other sheet 232 when the sheets 230 and 232 are brought together. The sheets 230, 232 are then heat welded together so that the contact regions between respective facing sheets 230, 232 are welded at a region surrounding the aperture 244, and other contact regions of the sheets 232 are thermally welded through the apertures 244. It will be appreciated that in this embodiment, the multiple union is effective in terms of strength but, unlike the FIG. 27 embodiment, may not be effective as a seal because part of the polyethylene ply of the sheets 232 overlay non-thermoplastic plies of the sheets 230.

Figure 29:
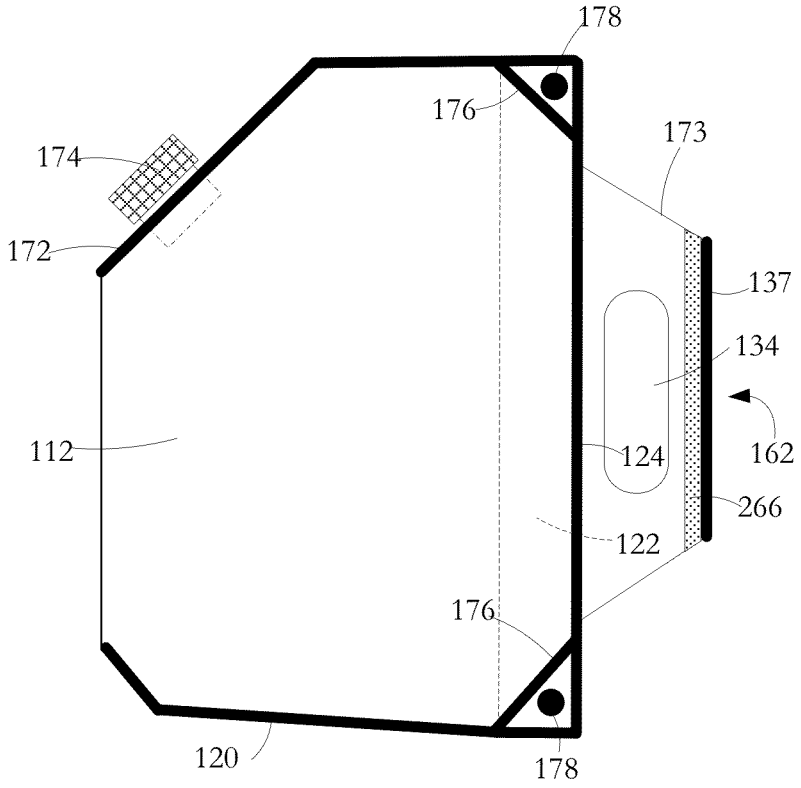
FIG. 29 is a side view of a bag according to another embodiment of the invention, the bag having a handle.

As previously indicated, a bag using the design principles of the invention may find application as a jug for containing and storing granular materials and fluids. One such arrangement is shown in FIG. 29. At the junction of the side opposite handle 162 and at the top edge of the bag, the corner is cut as shown along line 172 and a pouring spout/cap combination 174 is partially inserted between the cut front and back panels 112, 114. The cut edges at 172 are then seam welded to each other and sealed around the outer surface of the pouring spout 174. Whereas one form of pouring device is shown, it will be appreciated that the reclosable spout function can be provided by other means such as a slide fastener or zip, a Velcro® fastener, or, if closing is not important, by a simple opening which is cut at the time the container is first used. Although not shown in FIG. 29, the web from which the bag 10 is formed can be folded to introduce gussets at any or all of the top, bottom or other side of the bag. The additional gussets can alternatively be implemented as separate inserts with welds being applied to fix the inserts in position.

Depending on the particular carrying and pouring characteristics that are desired and the expected weight distribution of contents in the filled bag, it may be convenient to site the carrying aperture 134 other than generally centrally. For example, the carrying aperture may be situated closer to the top or bottom of the bag. In another alternative, the slot-form aperture may be oriented so as to be inclined to the vertical. In a further alternative, the carrying aperture 134 may be configured as a plurality of apertures for insertion of individual fingers to enhance pouring control.

It will be appreciated that the handle may be held atop the bag for carrying but is normally held at the side for pouring. To assist in the carrying mode if the bag contents will be heavy, any or all of its seams can be strengthened as part of the manufacturing process. A strengthening rod, tube or leaf of thermoplastic material is located at the region of a weld prior to welding so that when the weld is completed it provides greater stiffness than is obtained from a weld made solely of the thermoplastic sheet materials. This is particularly valuable for a bag as illustrated in FIG. 29 which is to function as a pouring jug. It will be understood that some dexterity may be necessary in handling a jug having the bag form described herein, especially if most of the original contents of the bag have been dispensed. As shown in FIG. 29, a locally strengthened zone is formed during manufacture by positioning a thermoplastic rod 266 at the site of the seam weld 137. When this seam is formed, the rod 266 is melted and melds with the material of the extension pieces 128, 129. When the bag is used to pour, the strengthened zone assists in maintaining the jug form of the bag as the contents become depleted. Such a rod or other form of strengthening element can alternatively be welded to the bag in a separate process step after the weld has been applied. In a further alternative, a strengthening element can be mechanically applied, such as by stapling.

Referring back to FIG. 14, whereas the various weld lines, whether they are to weld sheet material edges together as at the welds 118, 120 or to weld the faces of two panels together as shown at welds 124, 126, are shown in the illustrated embodiments simply as straight lines, other more complex welds can be used to obtain particular bag characteristics. For example, as shown in FIG. 29, at the end of the gusset panel 122, diagonal area welds 178 are used at each pair of the overlapping sheet materials to effect a neat end formation for the gusset panel 122. It will be appreciated that a weld may contribute to any or all of structural shape, strength sealing and "posture" benefits. For effective sealing, both to prevent loss of contents and also to prevent intrusion from outside of contaminants, welds must overlap at their junctions.

In each of the embodiments of the invention described, the bag is formed from sheet plastic material that is at least partly a heat-sealable thermoplastic material and sealing/welding is effected by heat sealing. Such materials include, by way of example and not limitation, polyolefins such as polyethylene and polypropylene, vinyl polymers, and the like. The materials may be low-, medium- or high-density polymers and may be single or multilayer composite material. Composite laminated materials may include adhesive layers. Sealing resins such as ethylene vinyl acetate may be used to improve sealing of certain polymer layers and the use of such sealing resins may obviate the use of adhesive tie layers.

The invention contemplates the use of thermoplastics films which are made of or which include, a barrier sheet material such as, for example, EVOH or a metal layer which provides a barrier generally preventing the transmission of gases. The thickness of the film material is selected mainly on the basis of the intended weight the bag must carry and generally ranges from about 2 to 20 mils. The type of thermoplastic sheet material used will depend on the purposes to which the bag, or the relevant part of it, is to be put, whether it is easy to handle in manufacturing, whether it can be readily printed upon, whether it is waterproof, whether it is strong enough to resist tearing or bulging, etc.

A particular implementation uses a multi-ply plastic sheet material including a polyethylene layer which makes effective thermoplastic welds/bonds and has high strength, and a layer of polyester which accepts printed indicia very well. In the manipulation of the web portions, generally polyethylene surfaces are brought together where two parts of the sheet material have to be joined so that a bond/weld can be implemented by using thermoplastic heat sealing techniques rather than adhesive bonding. Similarly such manipulation is configured so as generally to present the polyester surfaces outwardly for application of print indicia.

In one example, the sheet plastic material of the bag has a polyethylene layer 1 to 7 mils thick, an adhesive polymer layer 0.1 to 0.5 mils thick, and a polyester layer 0.5 mils thick, the layers being coextruded or adhesively laminated. The layer thicknesses can be varied depending on desired sheet material characteristics. For example, the polyester layer which is better suited for accepting printed indicia than the polyethylene, can be made somewhat thicker to provided increased stiffness to the bag. This can be quite important where the bag is to function as a pouring bag and will be lodged or stored in an upright position similar to a jug. The multilayer plastic material can include additional layers of material depending on characteristics desired in the finished material. In another example, the plastic sheet material has outer layers of polyethylene so that both surfaces of the material are heat sealable. In yet another example, the plastic sheet material has a layer of nylon for added strength and/or a barrier layer such as metal foil, metallized polyester or EVOH. The selection of ply materials and the number of layers of each material is chosen for the particular properties desired in the bag. Thus, polyethylene has good heat sealing properties and relatively high strength. A copolymer polyethylene with high elastomeric content can be used where a softer material is required. The sheet film material or particular web portions used in the bag construction can be formed from thermoplastic film that has been oriented during manufacture to impart mechanical strength along a particular axis or at a critical stress site. Such oriented strength can be imparted by for example stretching at ambient temperatures, melt orienting during extrusion, etc. Heat sealing and bonding of layers of sheet material is effected by the application of temperature and pressure for a predetermined time at locations where the layers are to be heat sealed. The temperature, pressure and time are selected based on the particular nature of the sheet materials being bonded together. Bonding is typically effected at multiple bonding stations, with the bonded material subsequently being cooled.

Whereas, in the illustrated embodiments of the invention, the various weld lines are shown as straight lines, other more complex welds can be used to obtain particular bag characteristics. A particular weld can contribute to any or all of the bag's shape, appearance, strength, sealing, stability and posture. The shape and exact positioning of welds can be selected with any or all of these benefits in mind. For effective sealing, both to prevent loss of contents and to prevent intrusion of contaminants into the bag, any two parts being welded must fully overlap at their junctions.

As previously mentioned, elements illustrated in the figures are not drawn to a common scale. In addition, the bag shapes are somewhat stylized in the sense that they do not illustrate the nature and location of bulges that may be present when a bag made of plastic film material contains an appreciable amount of liquid or particulate material, nor areas of relaxation or sagging that are present when the bag is partially emptied of such contents.

There have been described herein various embodiments of a bag structure. Also described in brief detail are particular production process steps involved in manufacturing such bag structures. Such embodiments and processes have features that distinguish the present invention from the prior art. It will be apparent to those skilled in the art that the bags and the manufacture thereof may be modified in numerous ways and may assume many embodiments other than the preferred forms specifically set out and described above. Accordingly, it is intended by the appended claims to cover all modifications of the invention which fall within the scope of the invention.

What is claimed is:

1. A bag for pouring formed of plastic film material, the bag having a first side panel, a second side panel, a rear gusset extending between the first and second side panels and joined to the first side panel at a first thermoplastic weld and joined to the second side panel at a second thermoplastic weld, a bottom gusset extending between the first and second side panels and joined to the first side panel at a third thermoplastic weld and joined to the second side panel at a fourth thermoplastic weld, a margin at front and top edges of the first side panel joining a margins at front and top edges of the second side panel at a fifth thermoplastic weld, a pouring device interrupting the fifth thermoplastic weld and sealed between the first and second panels at the front top of the bag, a bottom margin of the rear gusset joining a rear margin of the bottom gusset at a sixth thermoplastic weld whereby the rear and bottom gussets have an open gusset condition at the bottom rear of the bag and a handle comprising a first extension portion of the first side panel and a first extension portion of the rear gusset extending rearwardly from the first thermoplastic weld and thermoplastically welded to one another to form a first handle section, a second extension portion of the second side panel and a second extension portion of the rear gusset extending rearwardly from the second thermoplastic weld and thermoplastically welded to one another to form a second handle section, the first and second handle sections having front regions adjacent the first and second thermoplastic welds separate from one another to allow the open gusset condition at the bottom rear of the bag, and having rear regions thermoplastically welded together.

2. A bag as claimed in claim 1, at least a front part of the bottom gusset terminating as a generally triangular part at the fifth thermoplastic weld.

3. A bag as claimed in claim 2, at least a part of the bottom gusset generally triangular part extending diagonally upwardly to join said fifth thermoplastic weld when the bag is filled and seated on the bottom gusset.

4. A bag as claimed in claim 2, a rear part of the bottom gusset being generally rectangular.

5. A bag as claimed in claim 1, a bottom part of the rear gusset being generally rectangular.

6. A bag as claimed in claim 1, the bag having a generally wedge shaped horizontal sectional form over a major intermediate part of its height when the bag is full of product material and is seated on the bottom gusset.

7. A bag as claimed in claim 1, the rear gusset and a front part of the fifth thermoplastic weld extending generally vertically when the bag is full of product material and is seated on the bottom gusset.

8. A bag as claimed in claim 1, the bag having a rear gusset width of between 1.5 and 2.5 inches.

9. A bag as claimed in claim 1, the bag having a length from centre of the rear gusset to said front part of the first join of between 4 and 6 inches.

10. A bag as claimed in claim 1, in which at a front bottom corner of the bag, a first margin portion of the first side panel is thermoplastically welded to a second margin portion of the second side panel, a third margin portion of the first side panel is thermoplastically welded to a fourth margin portion of the bottom gusset, and a fifth margin portion of the second side panel is thermally welded to a sixth margin portion of the bottom gusset.

11. A bag as claimed in claim 1, in which at a rear bottom corner of the bag, a first margin portion of one of the side panels is thermally welded to a second margin portion of the rear gusset, a third margin portion of said one side panel is thermally welded to a fourth margin portion of the bottom gusset, and a fifth margin portion of the rear gusset is thermally welded to a sixth margin portion of the bottom gusset.

12. A bag as claimed in claim 1 in a prior-to-filling state, in which the margin at the top edge of the first side panel and the margin at the top edge of the second side panel are not joined to permit filling of the bag with product material prior to the bag being closed and sealed at the top edge with the product material inside.

13. A bag as claimed in claim 1, the pouring device being one of a spout, slider zipper, press-to-close zipper, or Velcro®-type fastening.

14. A bag as claimed in claim 1, the fifth thermoplastic weld having a middle part extending diagonally between a top part and a front part thereof, the pouring device sealed in the diagonally extending middle part.

15. A bag as claimed in claim 1, the pouring device sealed into a top part of the fifth thermoplastic weld.

16. A bag as claimed in claim 1, at least part of the bag made of a multi-ply material with at least one of the plies being one of a surface thermoplastic material, a surface layer amenable to accepting printing thereon, a barrier layer and a strength layer.

17. A bag as claimed in claim 1, the first and second side panels being generally rectangular in shape.

18. A bag as claimed in claim 1, the bottom gusset, where it is welded to the side panels and the rear gusset having a margin weld oriented as a coplanar extension of a main part of the bottom gusset.

* * * * *